US011969102B2

(12) United States Patent
Sun et al.

(10) Patent No.: US 11,969,102 B2
(45) Date of Patent: Apr. 30, 2024

(54) STOWAWAY COMPACT ROCKER

(71) Applicant: GCI Outdoor LLC, Higganum, CT (US)

(72) Inventors: Jim Sun, Cromwell, CT (US); Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 107 days.

(21) Appl. No.: 17/648,088

(22) Filed: Jan. 14, 2022

(65) Prior Publication Data

US 2022/0225773 A1 Jul. 21, 2022

Related U.S. Application Data

(60) Provisional application No. 63/137,948, filed on Jan. 15, 2021.

(51) Int. Cl.
*A47C 3/025* (2006.01)
*A47C 4/02* (2006.01)
(Continued)

(52) U.S. Cl.
CPC ..... *A47C 3/0255* (2013.01); *A47C 4/021* (2013.01); *A47C 4/03* (2013.01); *A47C 4/28* (2013.01);
(Continued)

(58) Field of Classification Search
CPC ..... A47C 3/0255; A47C 4/021; A47C 4/03; A47C 4/28; A47C 4/42; A47C 7/44;
(Continued)

(56) References Cited

U.S. PATENT DOCUMENTS 1,440,248 A * 12/1922 Shoemaker ..... A47C 4/42 297/51
1,969,313 A * 8/1934 Meeker ..... A47C 4/40 297/17

(Continued)

FOREIGN PATENT DOCUMENTS

CN 201064295 Y 5/2008
CN 211795405 10/2020
EP 2903479 B1 12/2017

OTHER PUBLICATIONS

International Search Report dated Apr. 20, 2022 for International Patent Application No. PCT/US2022/012562.

(Continued)

*Primary Examiner* — Robert Canfield
(74) *Attorney, Agent, or Firm* — Lathrop GPM LLP; Tucker Griffith

(57) ABSTRACT

A stowaway compact rocker having a set-up condition and a collapsed and bundled condition comprises a stationary chair frame base; a movable seating chair frame adapted for rocking movement relative to the stationary chair frame base; and a rocker mechanism operatively connected between the stationary chair frame base and the movable seating chair frame. The stationary chair frame base comprises a central axle tube; a pair of leg plates disposed on the central axle tube; front leg tubes; and rear legs tubes, each leg tube being adapted for connection to a leg plate. The movable seating chair frame comprises a pair of seat tube plates mounted on the central axle tube for rotation thereabout; seat member tubes, each being adapted for connection to a respective one of the seat tube plates; and back-rest tubes, each being adapted for connection to a respective one of the seat tube plates.

18 Claims, 15 Drawing Sheets

(51) Int. Cl.

| | |
|---|---|
| ***A47C 4/03*** | (2006.01) |
| ***A47C 4/28*** | (2006.01) |
| ***A47C 4/42*** | (2006.01) |
| ***A47C 7/44*** | (2006.01) |

(52) U.S. Cl.
CPC ..... *A47C 4/42* (2013.01); *A47C 7/44* (2013.01); *A47C 7/441* (2013.01); *A47C 7/444* (2018.08)

(58) Field of Classification Search
CPC ..... A47C 7/441; A47C 7/444; A47C 7/443; A47C 7/4454
See application file for complete search history.

(56) References Cited

U.S. PATENT DOCUMENTS

| | | | | |
|---|---|---|---|---|
| 8,454,084 | B2 * | 6/2013 | Lah | A47C 9/105 297/16.2 |
| 11,253,075 | B2 * | 2/2022 | Lah | A47C 4/42 |
| 2011/0148155 | A1 * | 6/2011 | Chapman | A47D 9/053 5/120 |
| 2014/0217801 | A1 | 8/2014 | Homans et al. | |
| 2016/0113402 | A1 * | 4/2016 | Lee | A47C 4/42 297/16.2 |
| 2019/0029430 | A1 | 1/2019 | Yang | |

OTHER PUBLICATIONS

Written Opinion of the International Searching Authority dated Apr. 20, 2022 for International Patent Application No. PCT/US2022/012562.

* cited by examiner

STOWAWAY COMPACT ROCKER

CROSS-REFERENCE TO RELATED APPLICATION

This application claims the benefit of U.S. Provisional Application Ser. No. 63/137,948, filed Jan. 15, 2021, which is incorporated herein by reference in its entirety.

FIELD OF THE INVENTION

The present invention generally relates to collapsible furniture, and more particularly relates to improvements in rocking chairs or seats that can be readily set-up for use and collapsed for transportation and storage. Even more particularly, the present invention relates to a collapsible and portable stowaway compact rocker designed especially for use as a beach chair, lawn chair, and the like, where the rocker, in a set-up condition, can be rocked by a seated user, and where the rocker can be readily collapsed from the set-up condition to a collapsed and bundled condition from transportation and/or storage.

BACKGROUND OF THE INVENTION

Popularity of the minivan, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved lightweight, collapsible and portable furniture for the picnicker, camper, spectator, sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort and/or functionality. The wooden beach chairs and lawn furniture of an earlier era have generally been replaced by light-weight tubular metal furniture of a more modern design. While newer lightweight designs have greatly improved transportability of such chairs, little has been done to optimize the collapsibility and portability of the full-sized article without compromising comfort, which is a general goal of the present invention.

Beach and lawn chairs adapted to be folded for transportation and/or storage typically have a frame fabricated from elongated structural members, preferably metal. Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. Due to the intricate interconnection of all the frame members, including for front-to-back, side-to-side and full X-Y quad chairs, such chairs often require all the legs to remain in contact with the ground to ensure safety and structural integrity of the chair during use. However, there is a desire for a rocking chair that is likewise foldable and portable, so that a user at a picnic or an outdoor event can relax in their chair and rock as desired.

Conventional beach and lawn chairs commonly have not been capable of rocking due to the design and construction of such chairs. For example, prior art pack chairs, which generally include chair frame members that can be attached to form a lightweight chair frame, and detached to break down the chair and bundle the components for transportation and storage, have heretofore not had rocking capability. Adding components to help the user rock in such chairs while seat either has not been feasible due to the design of the chair frame and its component parts or have compromised the ability of the chair to be collapsed and/or bundled, as desired. Moreover, added components have compromised the size and weight of the chairs so that they no longer collapse to a small and lightweight bundle that is optimal for transportation and storage.

Additionally, existing foldable rocking chair designs are commonly not suitable for most outdoor uses, especially on soft ground, dirt or sand. The limitations of such prior art chairs are mostly dues to the use of rocking components, such as arched rails or compression springs that both provide rocking motion but also support the chair frame when set-up. With such designs, the chair generally does not maintain full contact by all legs with the ground or support surface. On soft ground or sand, this aspect increases the risk that one or both sides of the chair will sink into the ground, get bogged down, through the chair frame off balance, overly torque or stress individual legs or frame component, and ultimately affect the set-up condition of the chair, the rocking motion of the chair and, more significantly, the integrity and safety of the chair to support a seated user.

In view of the foregoing, there is a need for a chair that can be rocked by a seated user when in a set-up condition that can also be collapsed in order to reduce the space occupied by the chair in a collapsed and bundled condition. Further, there is a need for such a chair that utilizes a common pack seat design, that can act as a collapsible and portable stowaway rocker chair that is easy to set-up and break down. Further, there is a need for such a chair that can be collapsed with minimal effort, without limiting or compromising the structural features permitting set-up and rocking of the chair. Further, there is a need for a chair that can be rocked by a seated user, as desired, without compromising the collapsing and transport of the chair, and without affecting the safety and structural integrity of the chair, especially on all types of surfaces, including soft ground and sand. In this regard, there is a further need for a collapsible and portable stowaway rocker chair with an adjustable rocker mechanism, whereby a user can adjust the rocking capability of the chair to accommodate the user's specific desires for use.

Accordingly, it is a general object of the present invention to provide a collapsible and portable rocking chair design of a compact stowaway chair, or pack seat, design that overcomes the problems and drawbacks associated with folding chairs and rocking chairs, and therefore significantly improves the utility of such a rocking chair in the set-up condition while permitting easy transportation and/or storage in a collapsed condition.

The present invention addresses these issues, and provides a means to circumvent the associated drawbacks of such prior art collapsible and portable rocking chair designs.

SUMMARY OF THE INVENTION

The present invention is directed to a stowaway compact rocking chair design that is collapsible and portable, and especially suitable for use as a beach chair, a lawn chair, and the like, where the chair, in a set-up condition, can be rocked by a seated user, and where the chair can be folded from the set-up condition to a collapsed and bundled condition for transportation and/or storage.

In accordance with a first embodiment of the present invention, a stowaway compact rocker having a set-up condition and a collapsed and bundled condition, and further having rocking capability when in the set-up condition comprises a stationary chair frame base and a movable seating chair frame adapted for rocking movement relative to the stationary chair frame base. In embodiments, the stationary chair frame base comprises a central axle tube; a pair of leg plates disposed at opposing longitudinal ends of the central axle tube; and a pair of front leg tubes and a pair of rear legs tubes, each of said front leg tubes and rear leg tubes being adapted for connection to a respective one of the leg plates. In embodiments, the movable seating chair frame comprises a pair of seat tube plates mounted on the central axle tube for rotation thereabout; a pair of seat member tubes, each of said seat member tubes being adapted for connection to a respective one of the seat tube plates; and a pair of back-rest member tubes, each of said back-rest member tubes being adapted for connection to a respective one of the seat tube plates. The rocker also includes at least one inner spring rod transversely connected between the seat tube plates, said at least one inner spring rod being adapted for rotational movement about the central axle tube with said seat tube plates; at least one outer spring rods transversely connected between the leg plates; and at least one center spring rod plate mounted on the central axle tube for rotation thereabout. The at least one inner spring rod and the at least one outer spring rod pass through the at least one center spring rod plate such that rotational movement of the at least one inner spring rod effects movement of the at least one center spring rod plate, which in turn flexes the at least one outer spring rod. In the set-up condition of the rocker, the movable seating chair frame is adapted for movement relative to the stationary chair frame base when a pressure is applied to at least one of the chair seat and the chair back-rest by a seated user, with the transverse connection of the spring rods and the interaction between the movable seating frame and the stationary chair frame effectuating the rocking action.

In embodiments of the present invention, a seating fabric is mounted to the seat member tubes and the back-rest member tubes of the chair frame in the set-up condition of the rocker and define a chair seat and a chair back-rest adapted to receive a seated user in the set-up rocker.

An alternative rocking mechanism can be used without departing from the spirit and principles of the present invention. For example, rocking motion can be imparted to the movable seating chair frame using torsion springs or other compliant members disposed between a movable component and a stationary component. In embodiments of the present invention, torsion springs may be disposed within each of the seat tube plates, and be relatively operatively connected between a respective seat tube plate and the central axle tube to effectuate the rocking motion for the chair.

In accordance with an alternative embodiment of the present invention, a stowaway compact rocker having a set-up condition and a collapsed and bundled condition, and further having rocking capability when in the set-up condition comprises a stationary chair frame base; a movable seating chair frame adapted for rocking movement relative to the stationary chair frame base; and a rocker mechanism operatively connected between the stationary chair frame base and the movable seating chair frame. The stationary chair frame base comprises a central axle tube; a pair of leg plates disposed at opposing longitudinal ends of the central axle tube; and a pair of front leg tubes and a pair of rear legs tubes, each of said front leg tubes and rear leg tubes being adapted for connection to a respective one of the leg plates. The movable seating chair frame comprises a pair of seat tube plates mounted on the central axle tube for rotation thereabout; a pair of seat member tubes, each of said seat member tubes being adapted for connection to a respective one of the seat tube plates; and a pair of back-rest member tubes, each of said back-rest member tubes being adapted for connection to a respective one of the seat tube plates. The movable seating chair frame is adapted for movement relative to the stationary chair frame base when a pressure is applied to at least one of the chair seat and the chair back-rest by a seated user.

In embodiments of the present invention, the rocker mechanism comprises compliant members engaged between movable components (e.g., the movable seating chair frame) and stationary components (e.g., the stationary chair frame base), such as transversely extending spring rods, flexible tension rods, torsion springs, leaf springs, and the like.

In an aspect of the present invention, the transverse positioning of the at least one center spring rod plate is adjustable by sliding movement along the central axle tube. Adjustment can be imparted by manual means or mechanical means (e.g., rack-and-pinion adjustment).

In an aspect of the present invention, the front leg tubes and the rear leg tubes are adapted to be disengaged from the leg plates for collapsing the rocker to its collapsed and bundled condition. Likewise, the seat member tubes and the back-rest member tubes adapted to be disengaged from the seat tube plates for collapsing the rocker to its collapsed and bundled condition. In preferred embodiments of the present invention, the front leg tubes, rear leg tubes, seat member tubes and back-rest member tubes are shock-corded to remain connected to the rocker even when in the collapsed and bundled condition of the rocker. Further, each removable frame member tube may include means for connecting the member tube to the central hub of the collapsed rocker to maintain the collapsed and bundled condition during storage and/or transportation.

These and other features of the present invention are described with reference to the drawings of preferred embodiments of a collapsible and portable rocking chair. The illustrated embodiments of features of the present invention are intended to illustrate, but not limit the invention.

DETAILED DESCRIPTION OF EMBODIMENTS OF THE INVENTION

The present invention is generally directed to collapsible and portable rocking chair, and more particularly, a stowaway compact rocker especially suitable for outdoor use as a beach chair, lawn chair, and the like, where the rocker, in a set-up condition, can be rocked by a seated user, and where the rocker can be readily collapsed from the set-up condition to a compact collapsed and bundled condition for transportation and/or storage.

Figure 9:
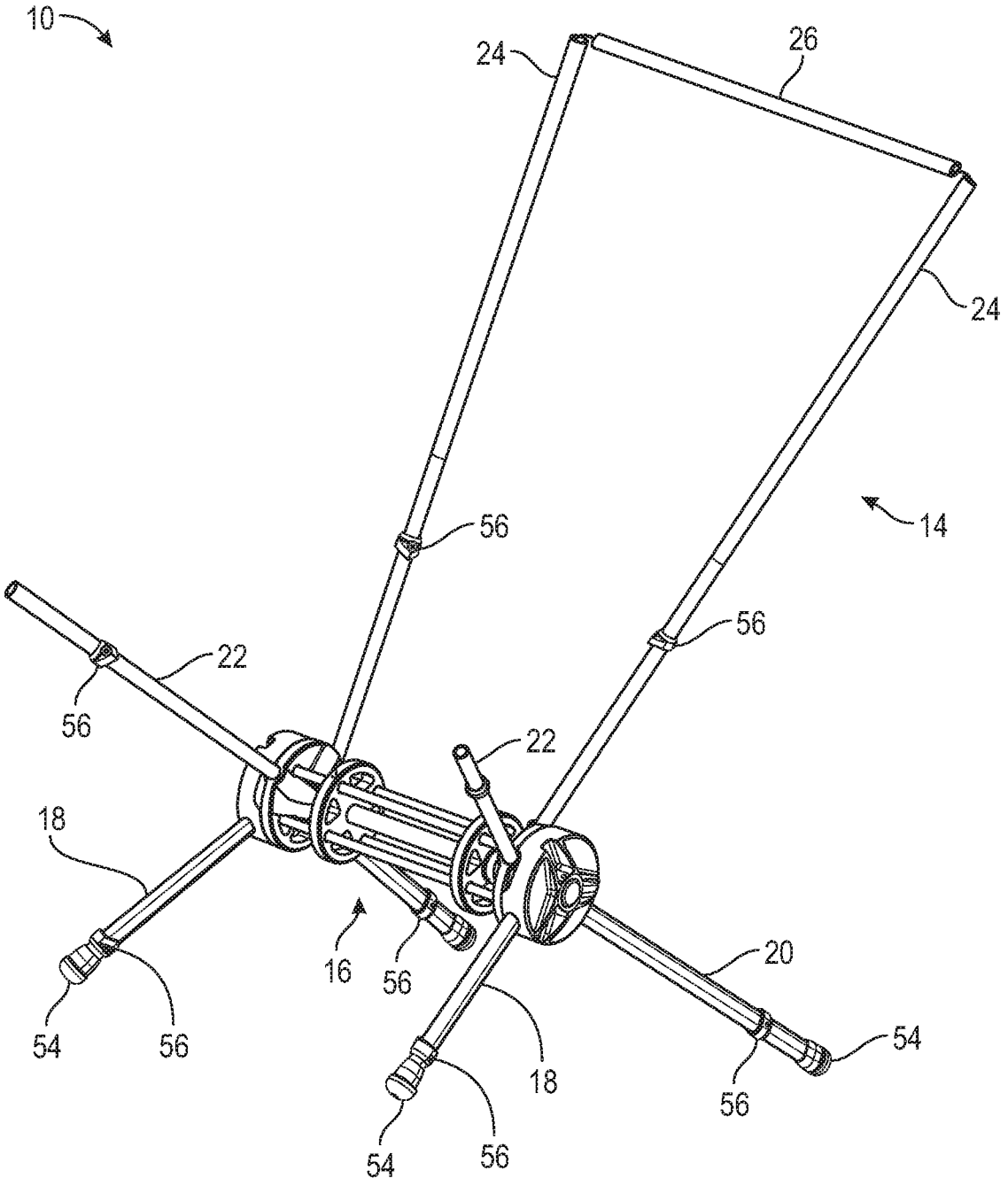
FIG. 9 illustrates a perspective view of a second embodiment of a chair frame in accordance with the present invention.
Figure 10:
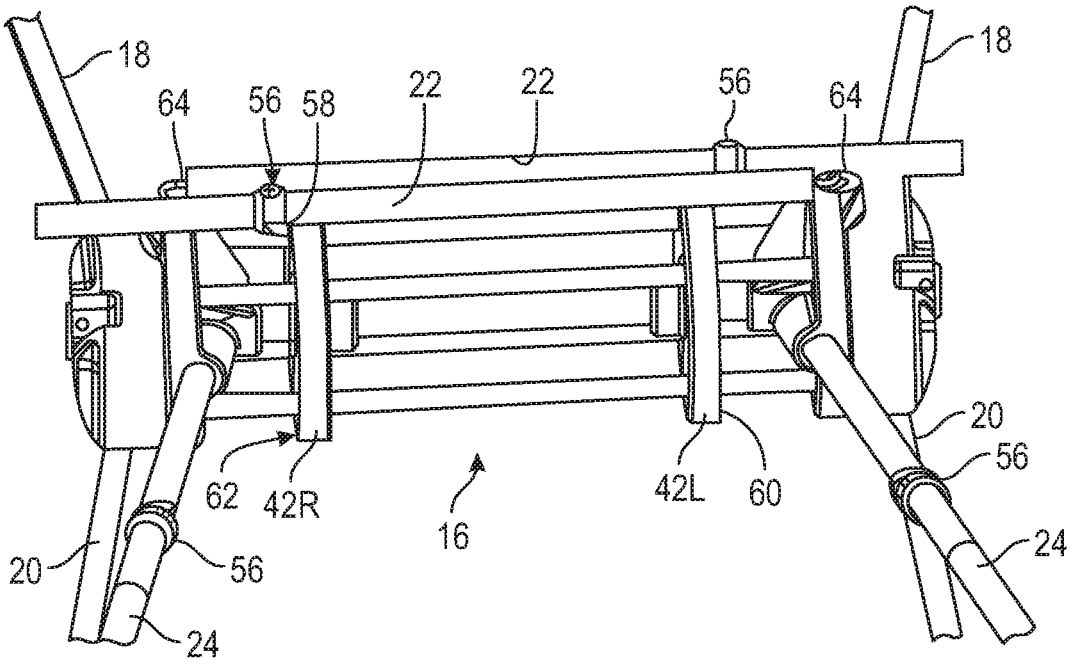
FIGS. 10-11 illustrate partial perspective views of the chair frame of FIG. 9 with frame members collapsed to a collapsed and bundled condition.
Figure 11:
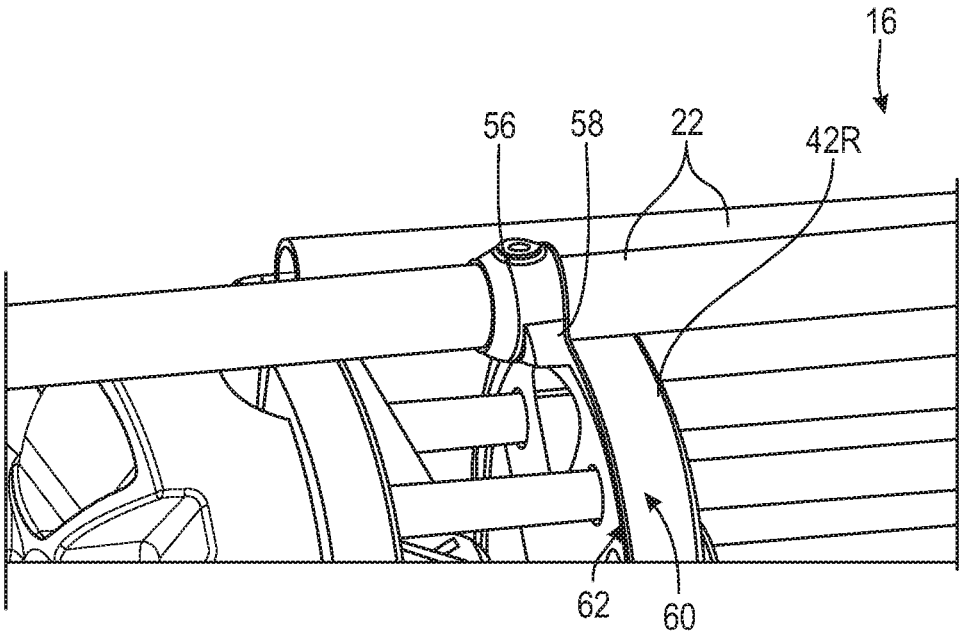
Figure 12:
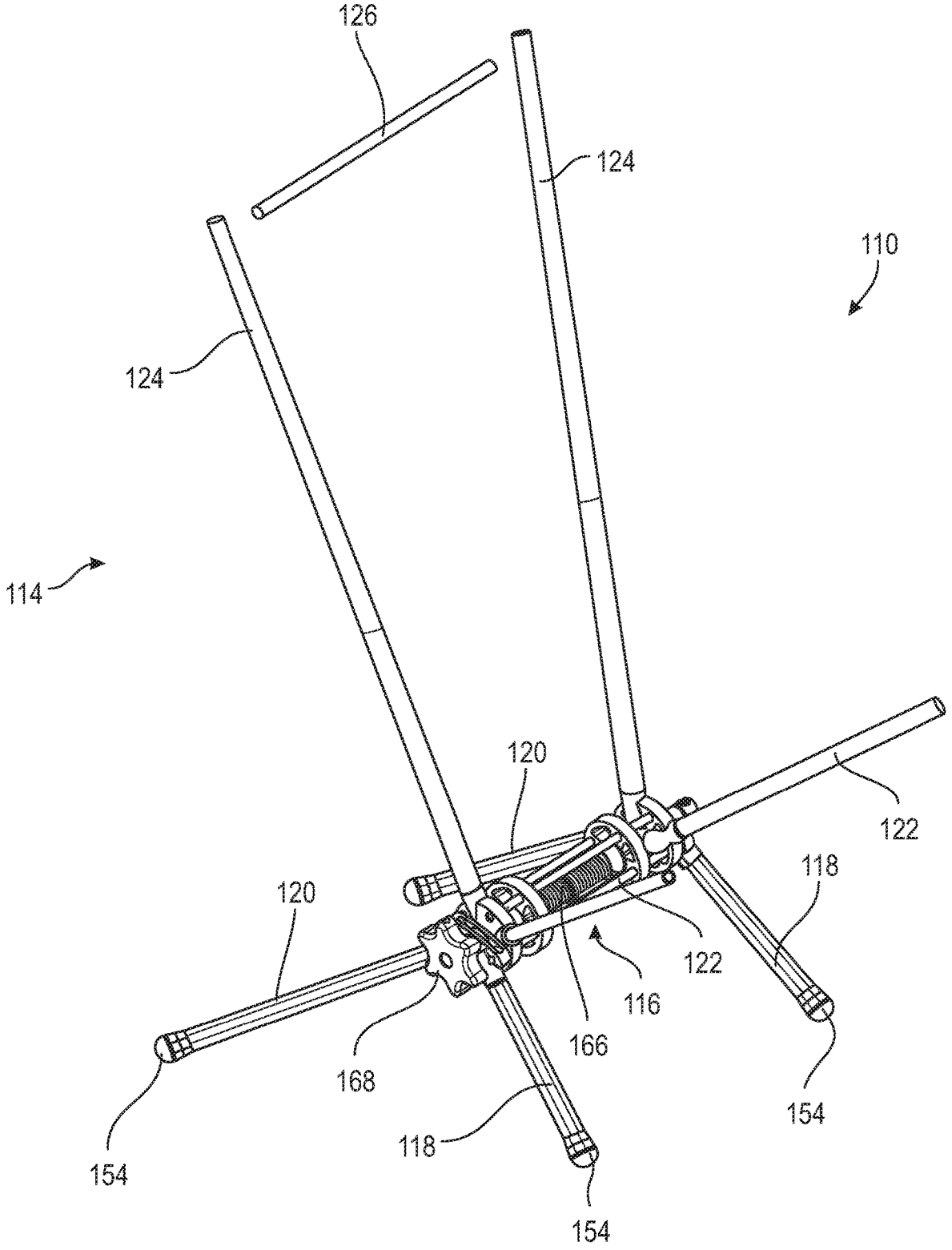
FIG. 12 illustrates a perspective view of a third embodiment of a chair frame in accordance with the present invention.
Figure 13:
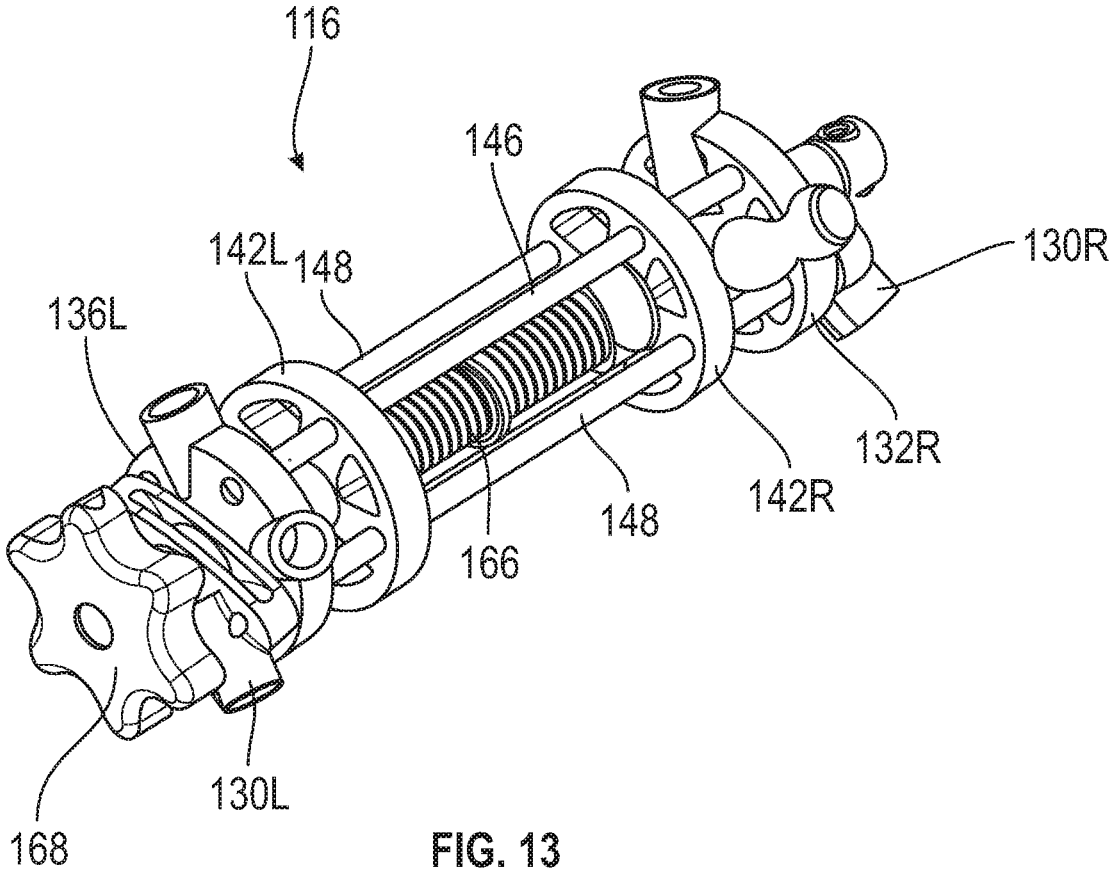
FIG. 13 illustrates a perspective view of the core of the chair frame of FIG. 12.
Figure 14:
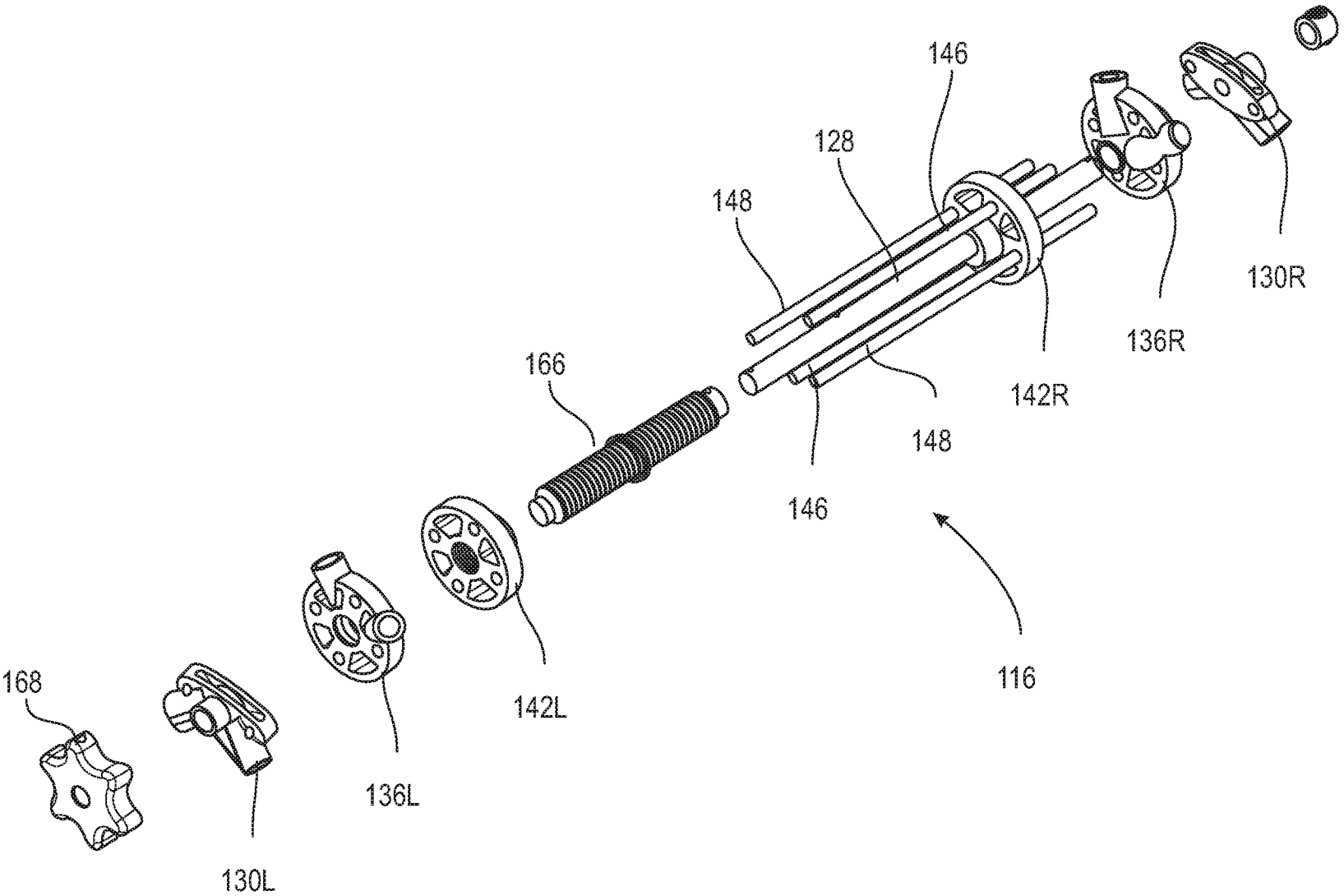
FIG. 14 illustrates an exploded perspective view of the core of FIG. 13.
Figure 15:
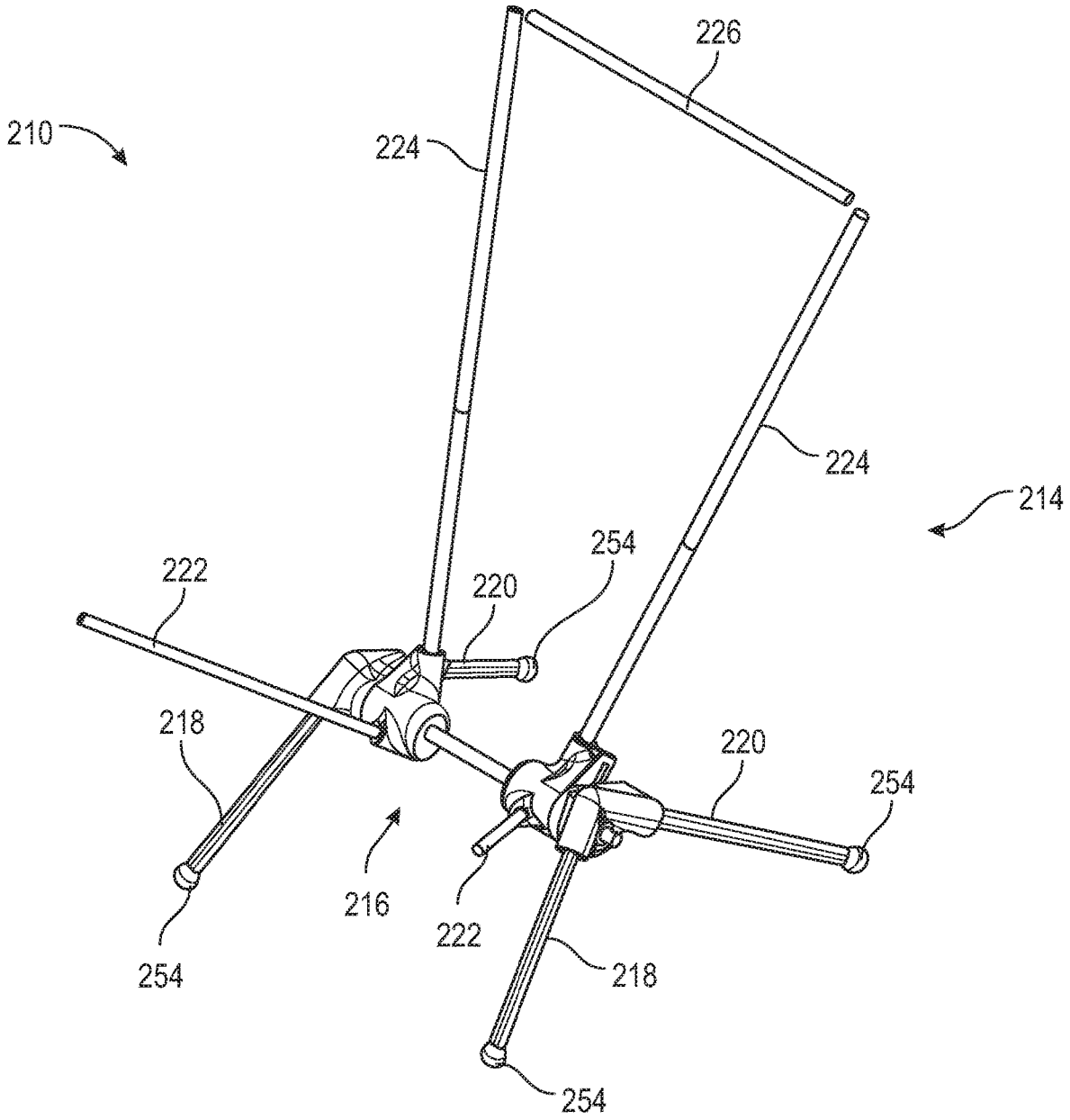
FIG. 15 illustrates a perspective view of a fourth embodiment of a chair frame in accordance with the present invention.
Figure 16:
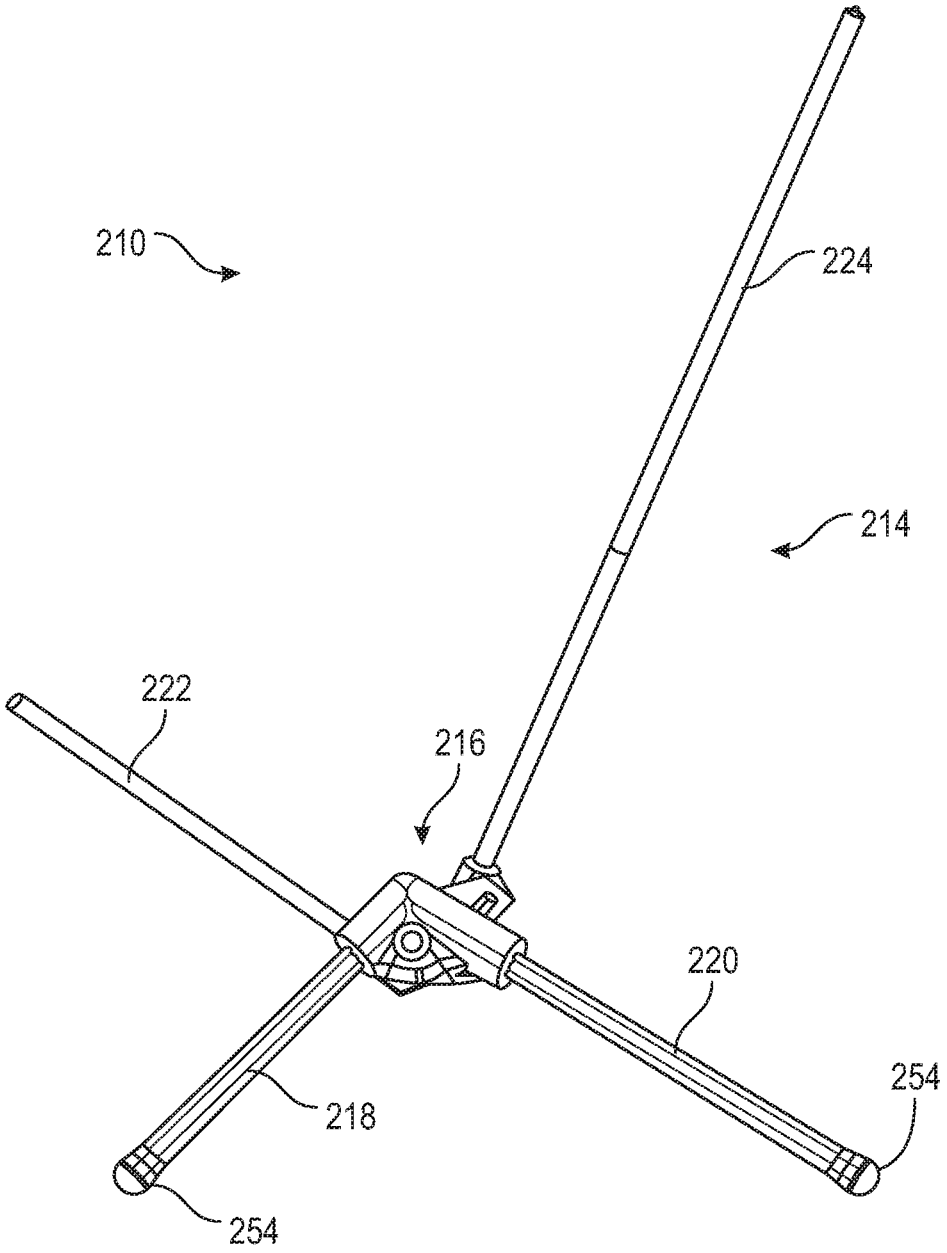
FIG. 16 illustrates a planar side view of the chair frame of FIG. 15.
Figure 17:
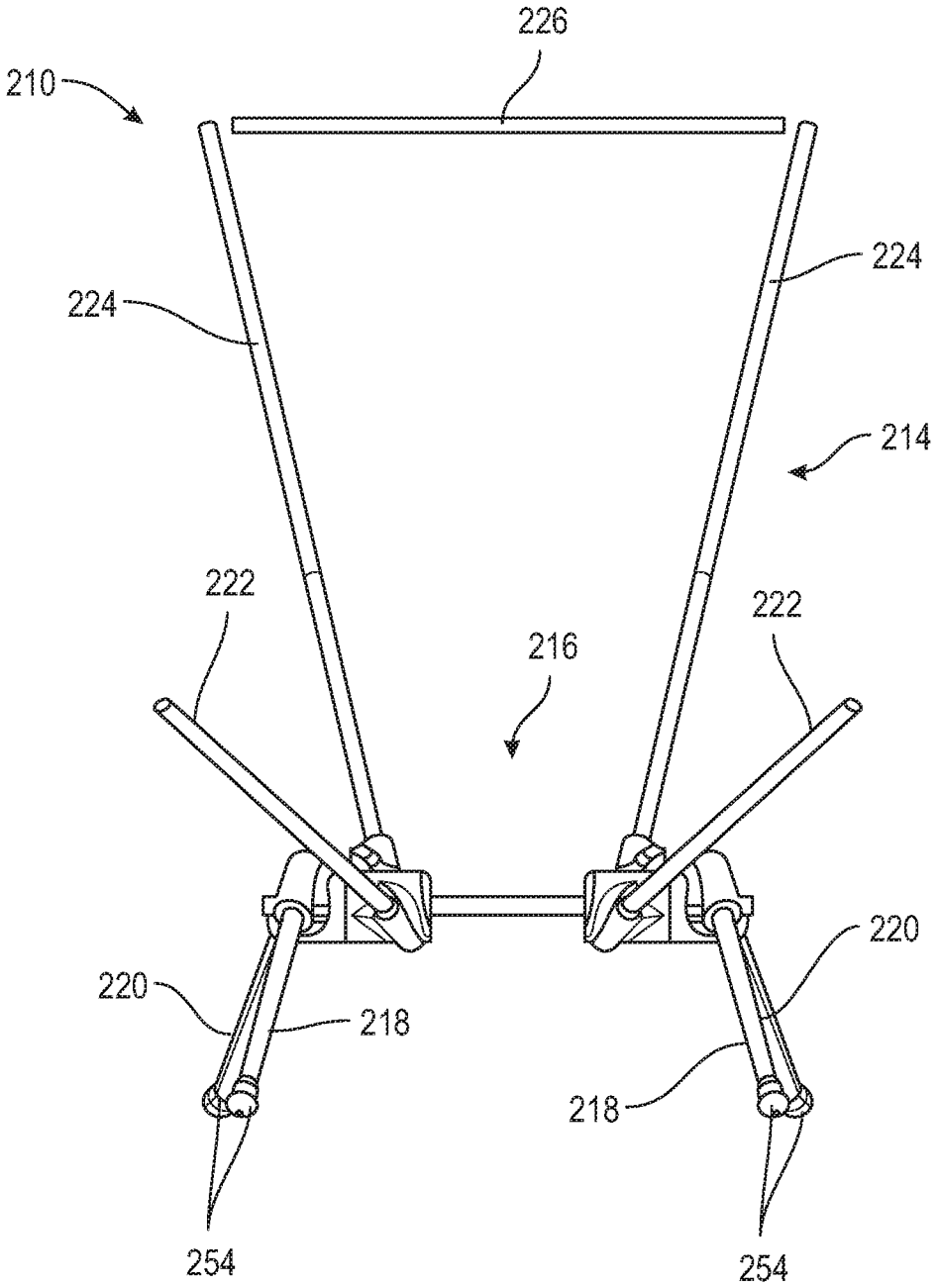
FIG. 17 illustrates a planar front view of the chair frame of FIG. 15.
Figure 18:
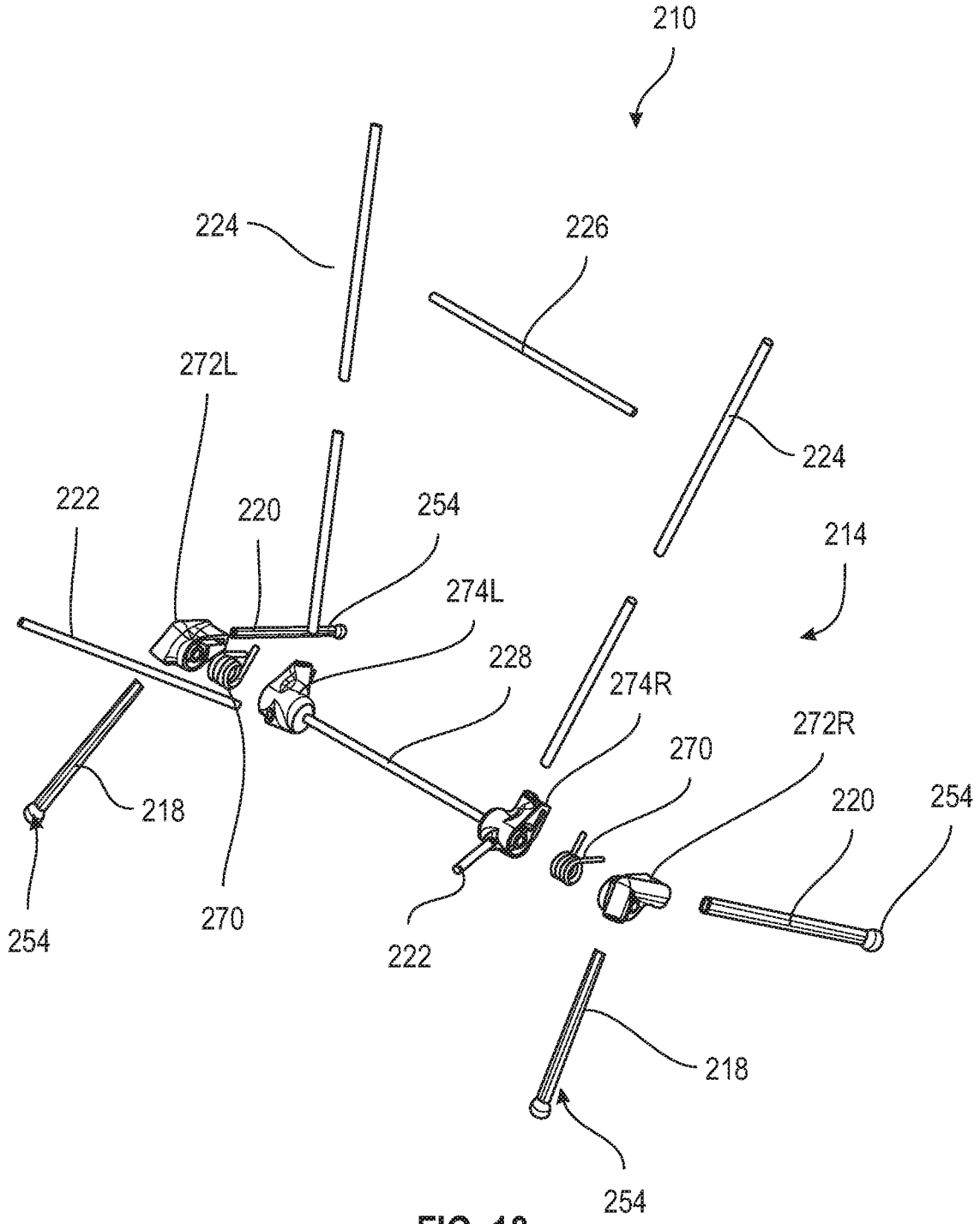
FIG. 18 illustrates an exploded perspective view of the chair frame of FIG. 15.

In the drawings and the description that follows, the present invention is illustrated and described with reference to stowaway compact rocker designs embodying the present invention. A first embodiment of such a rocker, generally designated as reference numeral 10, is illustrated in FIGS. 1-8. A second embodiment of a stowaway rocker in accordance with the present invention, provides means for securing the collapsed rocker 10 in its bundled condition, and is illustrated in FIGS. 9-11. A third embodiment of a stowaway rocker in accordance with the present invention, generally designated as reference numeral 110, is illustrated in FIGS. 12-14. A fourth embodiment of a stowaway rocker in accordance with the present invention, generally designated as reference numeral 210, is illustrated in FIGS. 15-20.

In preferred embodiments, the rocking capability for the stowaway compact rocker is adjustable to accommodate varied preferences of seated users. Additionally, preferred embodiments provide an adjustable rocking mechanism so that the rocking capability and comfort level can be optimized to the user's desires, said rocking mechanism comprising compliant members, such as spring rods, torsion springs, leaf springs or the like.

Figure 1:
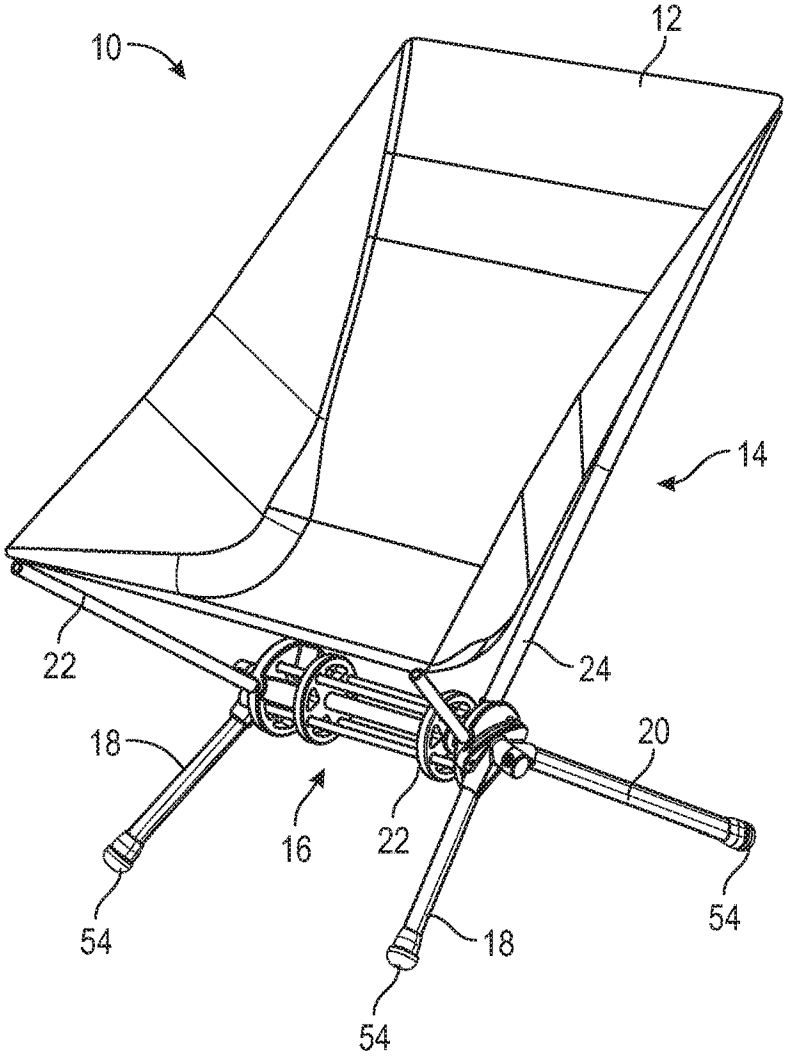
FIG. 1 illustrates a perspective view of a first embodiment of a stowaway compact rocker in accordance with the present invention.
Figure 4:
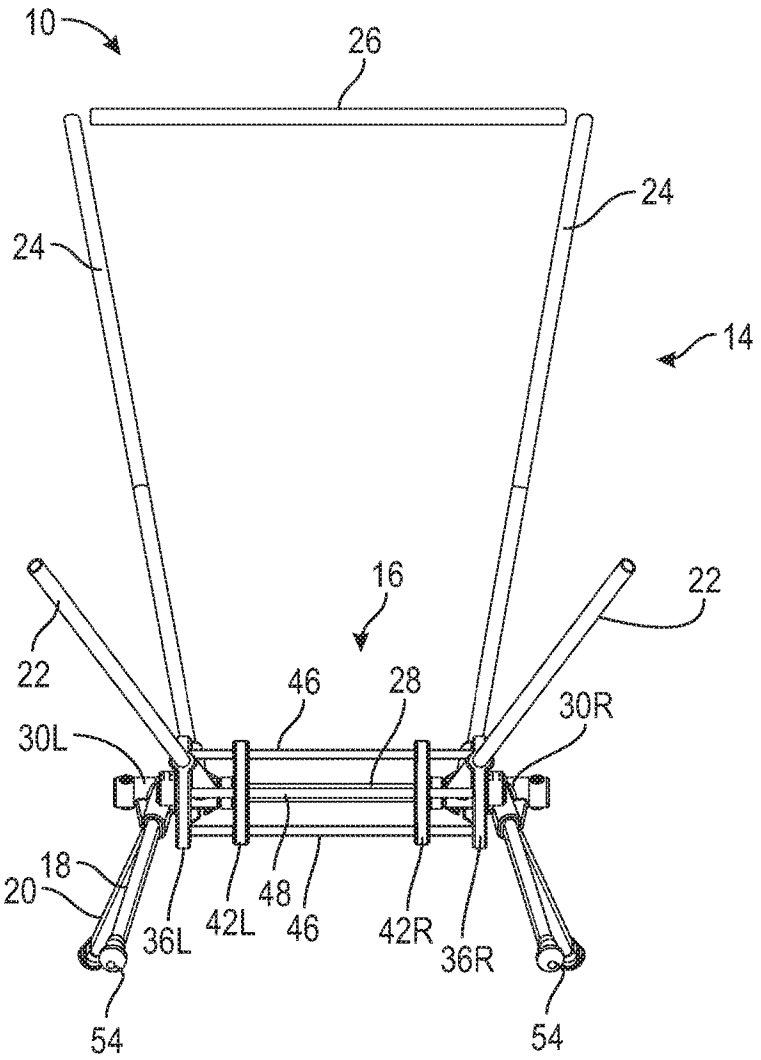
FIG. 4 illustrates a planar front view of the chair frame of FIG. 2.
Figure 3:
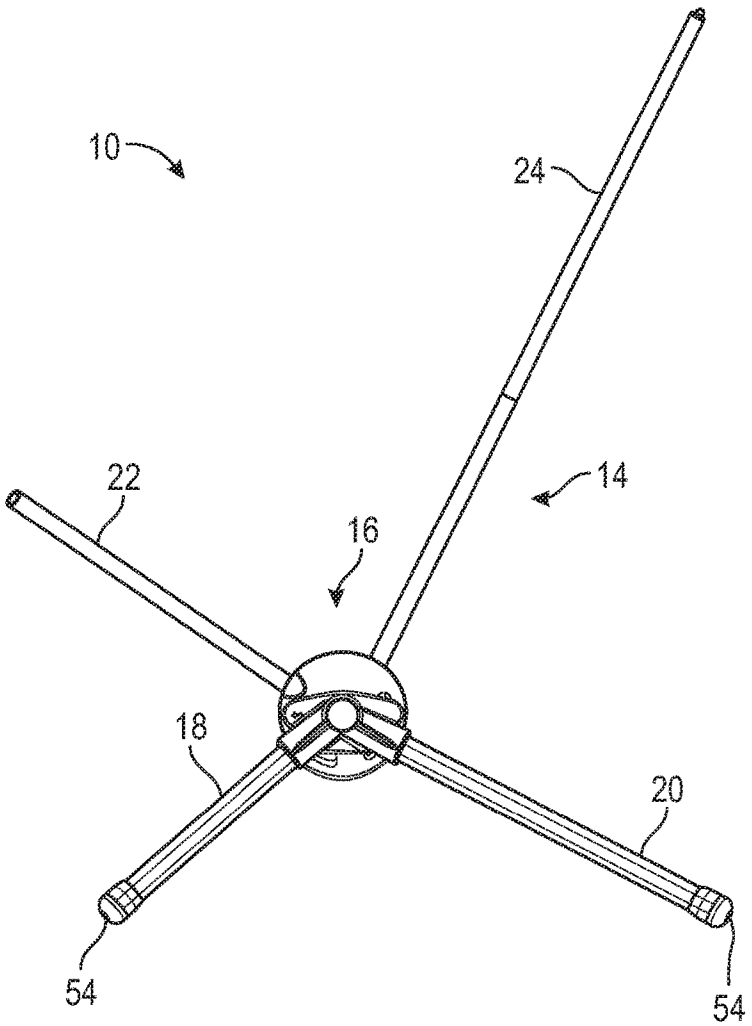
FIG. 3 illustrates a planar side view of the chair frame of FIG. 2.
Figure 6:
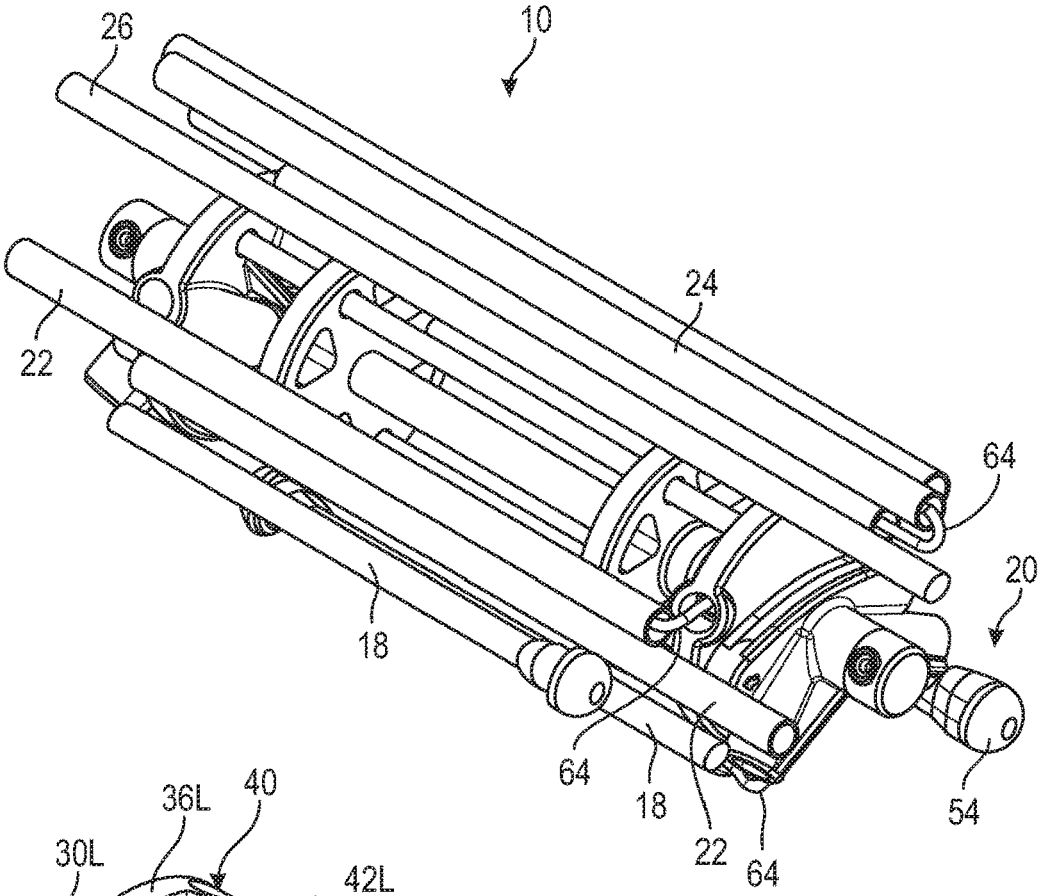
FIG. 6 illustrates a perspective view of the chair frame of FIG. 1 in a collapsed and bundled condition.

Referring to FIG. 1, a stowaway compact rocker 10 in accordance with the present invention is illustrated in a set-up condition for use. More particularly, a user can sit in the set-up rocker 10, and in accordance with the present invention, rock in the rocker 10 as desired. The stowaway compact rocker 10 can be easily set-up for use in a variety of environments, and especially for outdoor use at picnics, concerts, sporting events and the like. Likewise, the stowaway compact rocker 10 can be easily collapsed into a collapsed and bundled condition, such as illustrated in FIG. 6, for transport or storage when not in use. In FIG. 6, seating fabric 12 is removed to illustrate the collapsed and bundled relationship of the chair frame components in the collapsed and bundled condition of the chair/chair frame.

Figure 2:
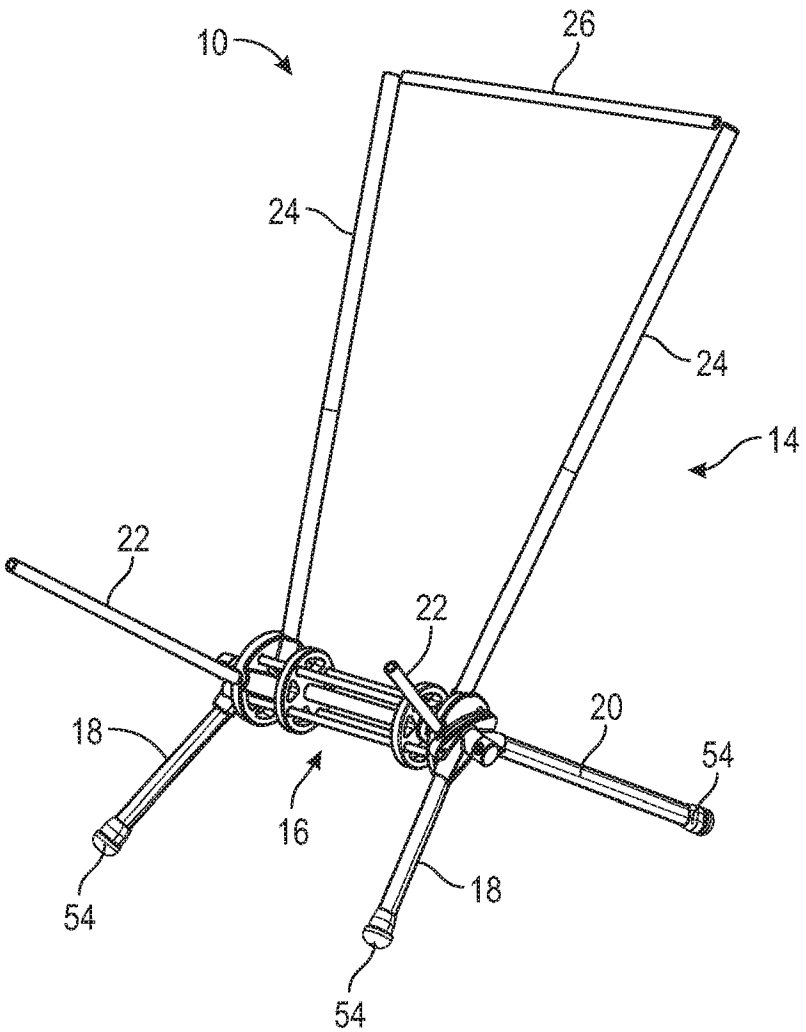
FIG. 2 illustrates a perspective view of a chair frame for the stowaway compact rocker of FIG. 1 in a set-up condition.

Referring to FIG. 2, the stowaway compact rocker 10 comprises a chair frame 14. The general structure of the chair frame 14 is consistent with conventional pack seat designs, and comprises a transversely extending central hub 16, a pair of front leg tubes 18 projecting forward and angled downward from the central hub 16, a pair of rear leg tubes 20 projecting rearward and angled downward from the central hub 16, a pair of seat tubes 22 projecting forward and angled upward from the central hub 16, and a pair of back-rest tubes 24 projecting rearward and angled upward from the central hub 16. Each of the front leg tubes 18, rear leg tubes 20, seat tubes 22 and back-rest tubes 24 is removably connected to the central hub 16, and when so attached, define the chair frame 14 and support a seating fabric 12 to receive a seated user. In the alternative, these frame members could remain connected to the central hub 16 and be movable between set-up and collapsed conditions, for example via pivotal, sliding, telescoping and flexing connection, and combinations thereof. The seating fabric 12, as mounted on the chair frame 14, is illustrated in FIG. 1, and is preferably provided in one piece. When the rocker 10 is not needed, the rocker 10 can be collapsed into a collapsed and bundled condition, as illustrated in FIG. 6, by first removing the seating fabric 12, and then disengaging the tube members 18, 20, 22 and 24 from the central hub 16, much in the manner illustrated in FIG. 5. Indeed, the bundled chair frame 14, as shown in FIG. 6, can be wrapped in the seating fabric 12, and then further stored in a storage/carrying bag (not shown). In alternate embodiments, the seating fabric 12 can be designed to act as a storage and carrying bag for the collapsed and bundled chair frame 14.

In preferred embodiments, the tube members 18, 20, 22 and 24 are internally shock-corded to facilitate ready and quick assembly and disassembly and allow for compact storage when the rocker 10 is not in use without risk of losing parts.

Referring to FIGS. 2-5, the front leg tubes 18, rear leg tubes 20 and seat tubes 22 are preferably made of single-piece construction of lightweight but rigid metal, for example, aluminum, but may also be fabricated from high-strength plastic. While the back-rest tubes 24 may also be made of single piece construction, they are preferably designed to be sectionalized, telescopically or otherwise, to reduce the footprint of the collapsed bundle while providing a high back-rest in the set-up condition of the pack seat rocker 10. A headrest brace 26 may be provided at the top of the back-rest tubes 24 to define and strengthen the head rest portion of the back-rest. The headrest brace 26 is disengaged from the back-rest tubes 24 to collapse the back-rest of the rocker 10. The back-rest tubes 24 and the headrest brace 26 are likewise made of lightweight but rigid construction, for example, metal (such as aluminum) or high-strength plastic, and may be shock-corded together to facilitate ready assembly and disassembly of the pack seat rocker 10. Various elongated structural parts or members comprising the chair frame 14 are preferably constructed from tubular material of circular cross-section, or in the alternative, or non-circular cross-section, such as, for example, extruded aluminum tubing having oval, elliptical, or square cross-section.

Figure 7:
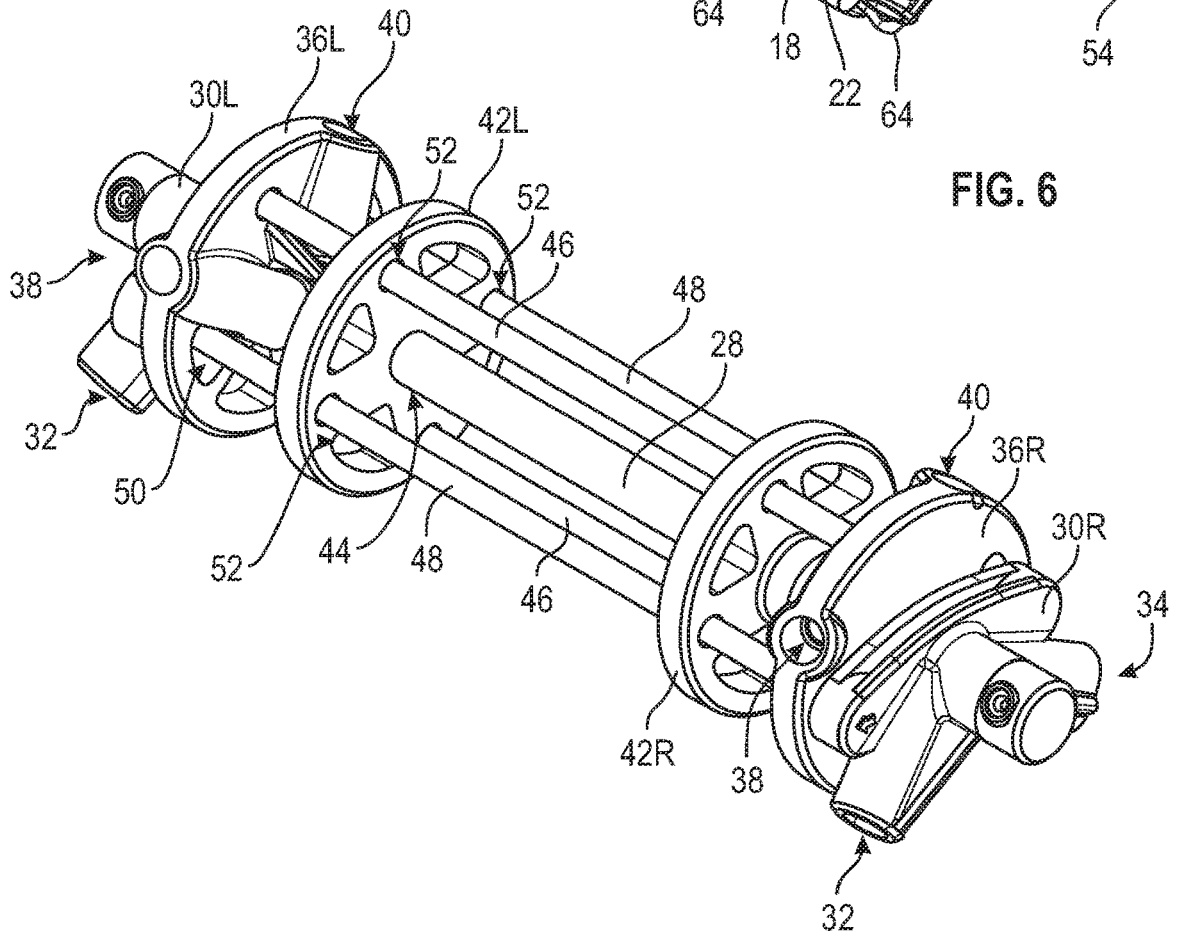
FIG. 7 illustrates a perspective view of the core of the chair frame of FIG. 2.
Figure 8:
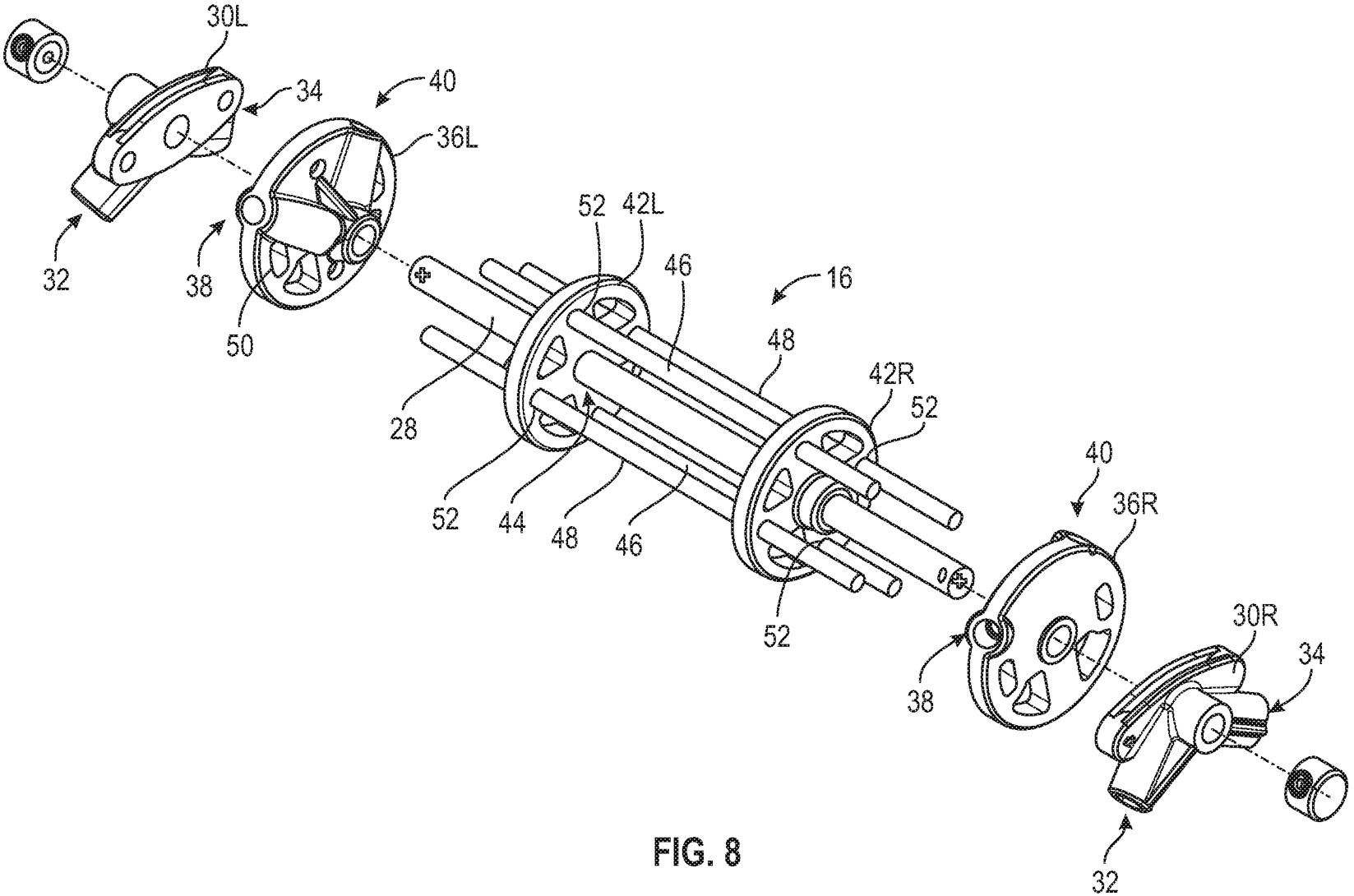
FIG. 8 illustrates an exploded perspective view of the core of FIG. 7.

Referring to FIGS. 7-8, the unique core or central hub 16 in accordance with the present invention is illustrated. Notably, each of the embodiments of the stowaway compact rocker of the present invention, unlike conventional pack seats available on the market, can be rocked by a seated user. Conventional pack seats merely provide a stationary seat when set-up. In the present invention, the rocking action is supplied by a rocking mechanism for effectuating a rocking motion between movable and stationary components of the chair frame. In the embodiment of FIGS. 7-8, the rocking mechanism comprises transverse spring rods or compliant members disposed in the central hub 16. More particularly, a spring force is provided by flexing compliant members, such as by bending the spring rods. Moreover, the present invention permits adjustment of the tension of the spring rods or compliant members to increase or reduce the rocking action of the stowaway compact rocker.

As illustrated, the central hub 16 comprises a stationary portion and a movable portion. The stationary portion comprises a central axle tube 28 transversely mounted between left and right leg plates 30L and 30R, each having mirrored construction to one another. A respective front leg tube 18 and rear leg tube 20 is connected to each of the leg plates 30L, 30R for set-up of the rocker 10. For example, each leg plate 30L, 30R includes front and rear cavities 32 and 34 adapted to snugly and securely receive the front and rear leg tubes 18 and 20, respectively. The leg tubes 18 and 20 can be removably snap fit into the cavities 32 and 34 to ensure a solid connection so that the set-up rocker 10 remains stable and sturdy when a user is seated, and especially when a user is rocking in the rocker 10. As noted, each of these components—the central axle tube 28, the left and right leg plates 30L, 30R, and the front and rear leg tubes 18 and 20, remain stationary when the rocker 10 is in its set-up condition, regardless of whether the user is rocking the seat or sitting stationary.

The movable portion of the central hub 16 comprises left and right seat tube plates 36L and 36R, each having mirrored construction to one another, that are mounted for rotation on the central axle tube 28. The seat tube plates 36L, 36R are positioned adjacent to and transversely inward of respective leg plates 30L, 30R. During rocking use of the stowaway compact rocker 10, the seat tubes 22 and the back-rest tubes 24 will move with rotation of the seat tubes plates 36L, 36R about the central axle tube 28. Each seat tube plate 36L, 36R includes cavities 38 and 40 for respectively receiving a seat tube 22 and a back-rest tube 24. The cavities 38, 40 are adapted to snugly and securely receive the seat and back-rest tubes 22 and 24. The seat tubes 22 and the back-rest tubes 24 can be removably snap fit into respective cavities 38 and 40 to ensure a solid connection so that the set-up rocker 10 remains stable and sturdy when a user is seated, and especially when the user is rocking.

The moveable portion of the central hub 16 also comprises left and right center spring rod plates 42L and 42R, each having mirrored construction to one another, that are mounted for rotation on the central axle tube 28. The central axle tube 28 extends through central annular openings 44 in each of the center spring rod plates 42L and 42R. The center spring rod plates 42L and 42R are not fixed into place, and in accordance with the present invention can be slid along the central axle tube 28 to adjust the rocking motion of the rocker 10. In this regard, the center spring rod plates 42L and 42R can be moved closer together or further apart to adjust the spring rate on transversely extending compliant members, such as spring rods, that facilitate the rocking motion imparted by the movable portion of the central hub 16. For example, the center spring plates 42L and 42R can be manually slid in or out along the central axle tube 28. Alternatively, the position of the center spring plates 42L and 42R can be mechanically adjusted, such as by a rack and pinion means as illustrated in FIGS. 12-14 and described herein below. When the center spring rod plates 42L and 42R are moved closer together, and thus, closer to a central axis of the chair frame 14, the seat and back-rest of the rocker 10 will have greater rocking motion due to decreased spring force. Conversely, when the center spring rod plates 42L and 42R are moved away from each other and closer to the sides of the chair frame 14, the rocking motion will be reduced due to increased spring force.

As noted, in preferred embodiments, the central hub 16 further includes four spring rods—two inner spring rods 46 and two outer spring rods 48—preferably constructed from steel which extend transversely parallel to the central axle tube 28. The inner spring rods 46 are transversely connected between the seat tube plates 36L and 36R and thus rotate with movement of the seat tube plates 36L and 36R. The outer spring rods 48 are transversely connected between the leg plates 30L and 30R, extending through arced slots 50 in the seat tube plates 36L and 36R, and thus do not rotate with movement of the seat tube plates 36L and 36R. Each of the inner spring rods 46 and outer spring rods 48 also extend through openings 52 in the center spring rod plates 42L and 42R, and when the position of said plates 42L and 42R is adjusted, the plates 42L and 42R slide along the length of the inner and outer spring rods 46 and 48.

In preferred embodiments, the center spring rod plates 42L and 42R are tightly fitted around the inner spring rods 46 and the outer spring rods 48. Adjusting the lateral position of the center spring rod plates 42L and 42R corresponding adjusts the tension applied to the spring rods 46 and 48, and thus the spring rate of said spring rods 46 and 48, during rocking motion of the rocker 10.

Though illustrated as having two inner spring rods 46 and two outer spring rods 48, the number, and relative placement, of spring rods can vary without departing from the spirit and principles of the present invention. For example, a single inner spring rod 46 can be transversely positioned between the seat tube plates 36L and 36R and a single outer spring rod 48 can be transversely positioned between the leg plates 30L and 30R. Alternatively, the number of inner springs rods 46 does not need to match the number of outer spring rods 48.

Similarly, the present invention can use a single center spring rod plate 42 that is adjustable along the central axle tube 28. Additionally, the form of said center spring rod plates 42L and 42R can be altered without departing from the spirit and principles of the present invention. Fundamentally, the center spring rod plate(s) 42 serve as an "activator" for bending the compliant members connecting the outer plates once a user rocks the rocker 10, thus creating the reaction/spring force in the transversely extending compliant members. In this regard, the center spring rod plates 42L and 42R can be plates mounted around the central axle tube 28 and the compliant members, as illustrated, or in the alternative, take the form of spokes, levers, cam linkages, or the like that engage and manipulate the compliant members to impart a force to create a reaction/spring force therein.

In use of the set-up stowaway compact rocker 10 for rocking motion, when the user leans back on the back-rest or forward on the seat, the movable portion of the central hub 16 will pivot or rotate backwards and forward relative to the stationary portion of the central hub 16. Thus, the seat tube plates 36L and 36R will rotate about the central axle tube 28. As a result, the seat and back-rest portions of the rocker 10 will also move in backwards and forwards directions. The front and rear legs 18 and 20 remain stationary. The rocking motion of the movable portion of the central hub 16 will cause the inner spring rods 46, attached between each of the seat tube plates 36L and 36R, to rotate therewith, which will rotate the center spring rod plates 42L and 42R. Movement of the center spring rod plates 42L and 42R applies a rotational pressure to the outer spring rods 48, fixedly attached between each of the stationary leg plates 30L and 30R, which adds tension to the outer spring rods 48, bending and flexing them with motion of the movable portion of the rocker 10. The flexing of the outer spring rods 48 essentially creates a spring or compliant member supplying the rocking action of the rocker seat, twisting in one direction and then the other in connection with back and forth rocking motion of the rocker 10.

Figure 5:
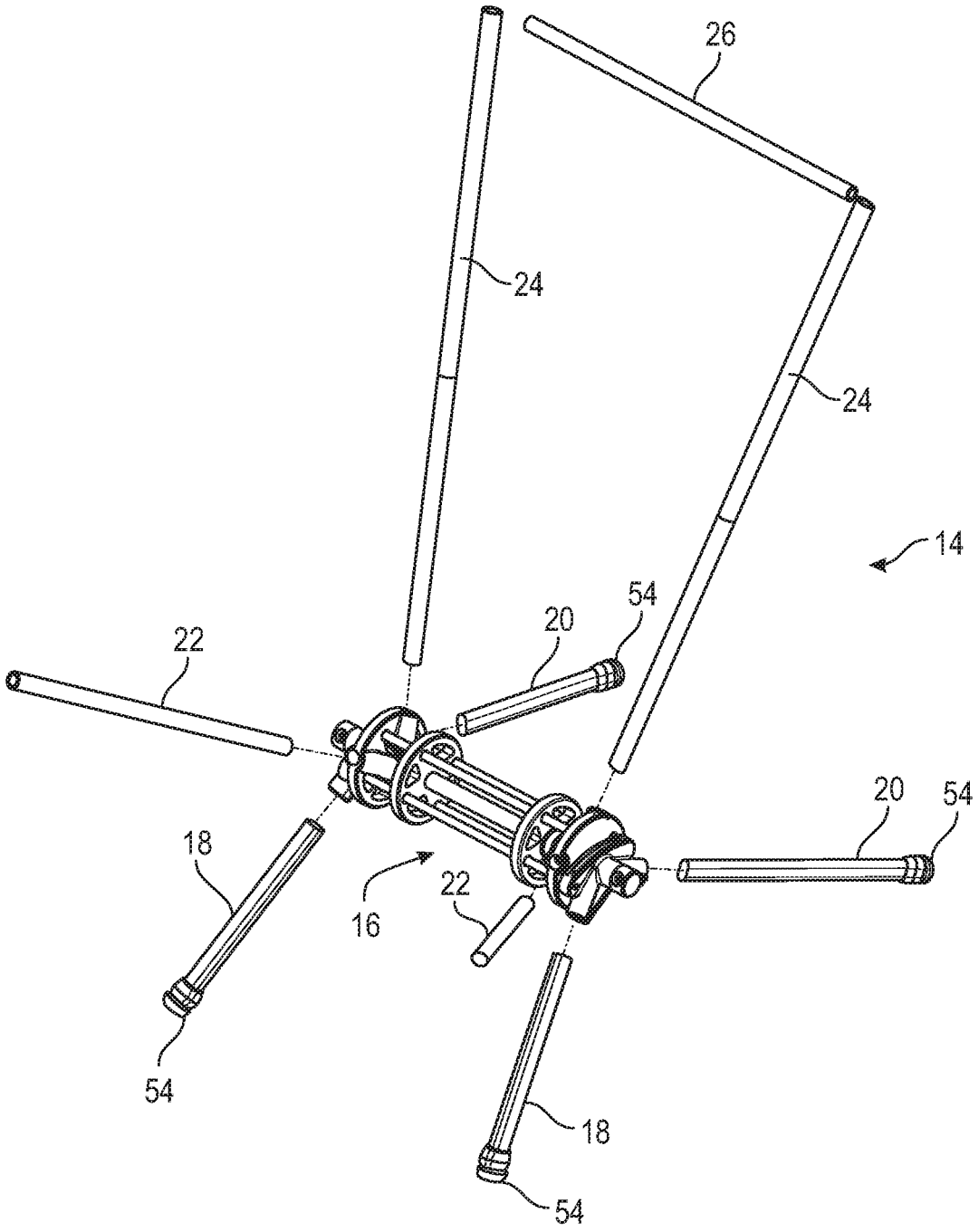
FIG. 5 illustrates an exploded perspective view of the chair frame of FIG. 2.

To collapse the stowaway compact rocker 10, the seating fabric 12 is removed from the chair frame 14. Then, the frame tube members 18, 20, 22 and 24 described herein are disengaged from the central hub 16 to create a seat bundle (FIG. 6) for easy transport or storage of the rocker 10. As noted, each of the frame tube members 18, 20, 22 and 24 is internally shock-corded so that all the frame members stay connected, cannot be lost, and can be easily reconnected to set-up the rocker 10 in an efficient and quick fashion. For example, as illustrated in FIGS. 5-6, the front and rear leg tubes 18 and 20 are removed from their cavities 32 and 34 in the leg plates 30L and 30R and preferably repositioned in generally parallel relationship to the central axle tube 28. Likewise, the seat tubes 22 are removed from their cavities 38 in the seat tube plates 36L and 36R and similarly positioned generally parallel to the central axle tube 28. The back-rest tubes 24 are also removed from their cavities 40 in the seat tube plates 36L and 36R, and the sectioned portions of said back-rest tubes 24 are disengaged, along with the headrest brace 26, and all components bundled and repositioned generally parallel to the central axle tube 28. Once all the frame members have been removed and bundled, the entire bundle can be wrapped with the seating fabric 12 and placed in a storage/carrying bag (not shown) for transport and/or storage.

As illustrated in FIG. 1, each leg tube 18 and 20 includes a foot 54 at the bottom end thereof to stabilize the set-up rocker 10 on any surface, such as grass, dirt, sand or hard floor.

In accordance with preferred embodiments of the present invention, each frame member—namely, the front leg tubes 18, the rear leg tubes 20, the seat tubes 22 and the back-rest tubes 24—may include means for connecting and securing the frame members in the collapsed and bundled condition of the rocker 10. As illustrated in FIG. 9, each removable frame member includes a collar having a hook, clip or other projection, collectively generally designated as reference numeral 56. Referring to FIG. 11, the center spring rod plates 42L and 42R are provided with a lip 60 defining a slot or channel 62 around the outer perimeter thereof. Preferably, the collars are secured (e.g., by rivet) to each removable tube member 18, 20, 22 and 24 at a position so that the hook 56 will engage the lip 60 in the center spring rod plate 42L and 42R when the frame member 18, 20, 22 and 24 is folded to its collapsed position, as illustrated in FIGS. 10-11. More preferably, when the frame member 18, 20, 22 and 24 is folded to a position adjacent to the central hub 16, the collar and hook 56 will be positioned close to the center spring rod plate 42L and 42R, and the shock cord (illustrated as reference numeral 64 in FIG. 10) will add a tension bringing the collar and hook 56 into alignment therewith so that the hook 56 engages the lip 60 and the slot or channel 62 in the center spring rod plate 42L, 42R, thus securing the frame member 18, 20, 22 and 24 in place so that it does not come lose when the rocker 10 is in its collapsed and bundled condition. As noted, this means of connection is provided on each of the front leg tubes 18, rear leg tubes 20, seat tubes 22 and back-rest tubes 24, as illustrated in FIGS. 9-10.

In an alternate embodiment of the present invention, as illustrated in FIG. 12, rocking capability of the stowaway compact rocker 110 can be adjusted by different adjustment means. The general structure of the chair frame 114 is the same or similar to the rocker 10 and chair frame 14 illustrated in FIGS. 1-6 and described above, and common components share similar numerical designations.

As illustrated in FIGS. 13-14, a threaded central tube 166 is mounted on the central axle tube 128. The center spring rod plates 142L and 142R are threaded on the interior opening and engage the complementary thread on the central tube 166. Adjustment of the center spring rod plates 142L and 142R is via rack-and-pinion means using an adjustment knob 168 provided on one or both sides of the chair frame 114 in operative communication with the central axle tube 128. In operation, when the knob 168 is rotated—either clockwise or counterclockwise—the central axle tube 128 will rotate. As a result of the rotational movement of the central axle tube 128, the threaded central tube 166 will rotate, which, in turn, moves the center spring rod plates 142L and 142R towards or away from each other depending on the rotational direction imparted to the threaded central tube 166.

Though the central axle tube 128 is mounted for rotation to adjust the position of the center spring rod plates 142L and 142R, the central axle tube 128 and the threaded central tube 166 remain stationary (i.e., do not rotate) during rocking motion of the rocker 110. In this regard, the knob 168 can include a locking mechanism (not shown) to lock the position of the center spring rod plates 142L and 142R during rocking use of the chair 110.

Figure 19:
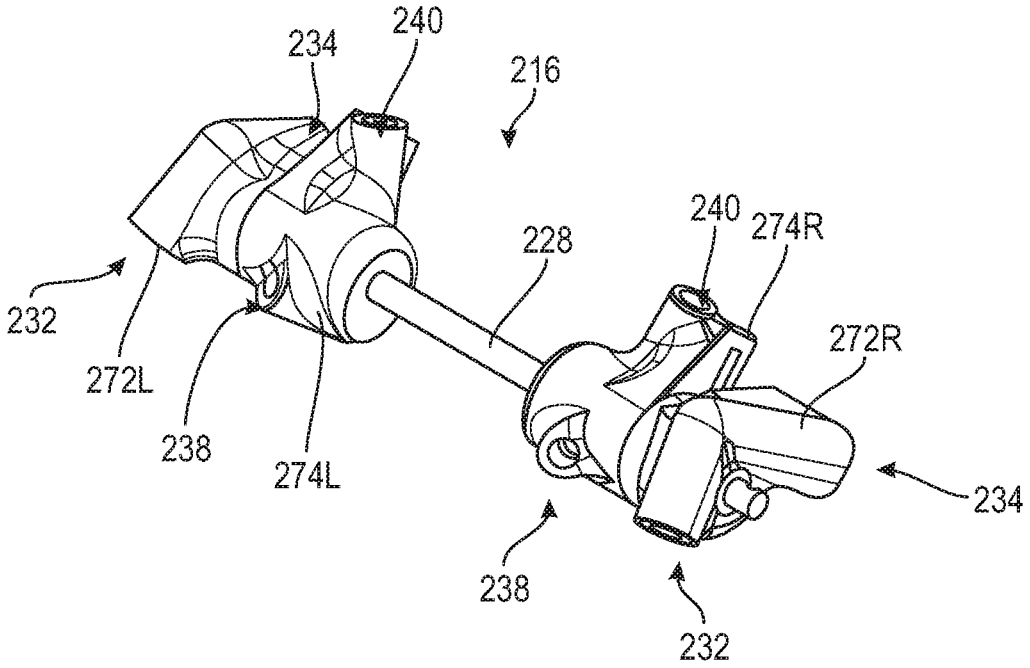
FIG. 19 illustrates a perspective view of the core of the chair frame of FIG. 15.
Figure 20:
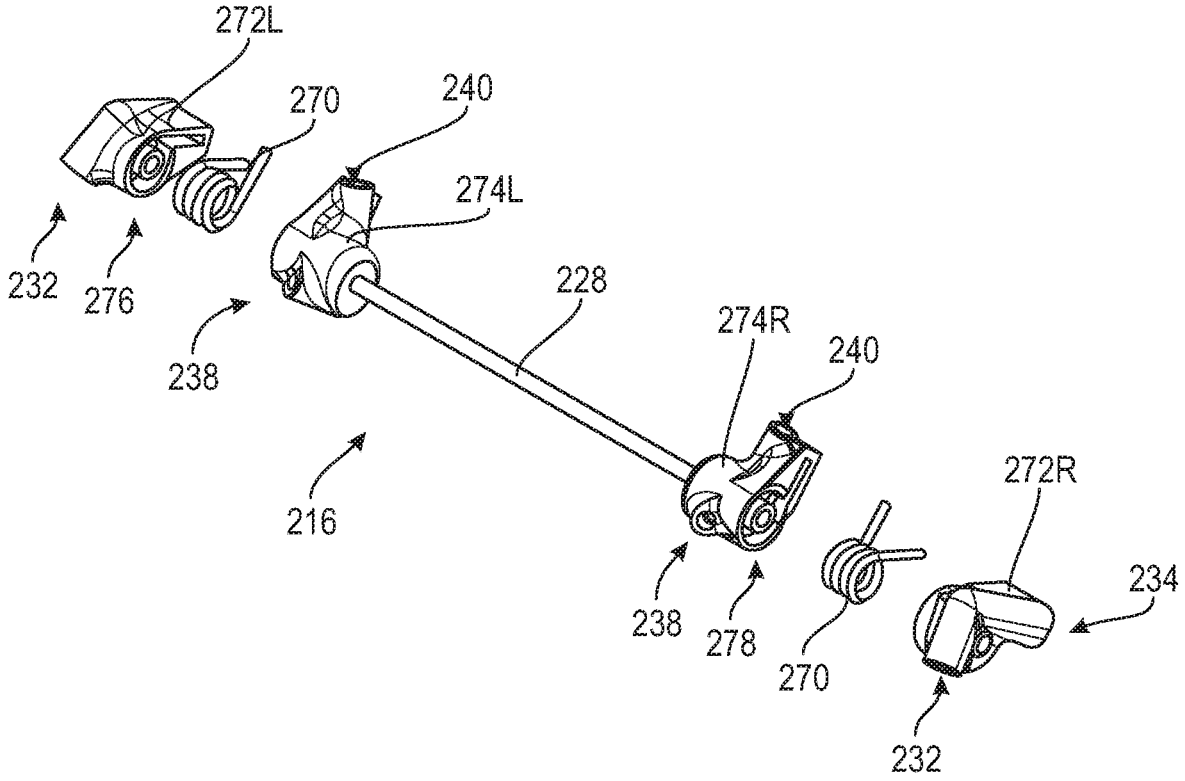
FIG. 20 illustrates an exploded perspective view of the core of FIG. 19.

Another alternate embodiment of the present invention is illustrated in FIGS. 15-20, and shows a stowaway compact rocker 210. The general structure of the chair frame 214 for rocker 210 is the same or similar to the rocker 10 and chair frame 14 illustrated in FIGS. 1-6 and described above, with modifications to the rocking mechanism. More particularly, the core or central hub 216, as illustrated in FIGS. 19-20, comprises a different compliant design to impart rocking motion to the rocker 210. Common components share similar numerical designations.

As illustrated, rocking of the chair frame 214 can be facilitated by torsion springs 270 provided on each side of the chair frame 214. As with other embodiments described herein, the central hub comprises a stationary portion and a movable portion. The stationary portion of the rocker 210 comprises left and right outer housings 272L and 272R, each having mirrored construction to one another. A respective front leg tube 218 and rear leg tube 220 is connected to each of the outer housings 272L and 272R for set-up of the rocker 210. For example, each outer housing 272L and 272R includes front and rear cavities 232 and 234 adapted to snugly and securely receive the front and rear leg tubes 218 and 220, respectively. The leg tubes 218 and 220 can be removably snap fit into the cavities 232 and 234 to ensure a solid connection so that the set-up rocker 210 remains stable and sturdy when a user is seated, and especially when the user is rocking the rocker 210. As noted, each of these components—namely, the left and right outer housings 272L and 272R, and the front and rear leg tubes 218 and 220—remains stationary when the rocker 210 is in its set-up condition, regardless of whether the user is rocking the seat or sitting stationary.

The movable portion of the central hub 216 comprises left and right inner housings 274L and 274R, each having mirrored construction to one another, that are mounted for rotation on and with a central axle tube 228 extending between said inner housings 274L and 274R. The inner housings 274L and 274R are positioned adjacent to and transversely inward of the outer housings 272L and 274R, respectively. During rocking use of the stowaway compact rocker 210, the seat tubes 222 and the back-rest tubes 224 will move with rotation of the inner housings 274L and 274R about a central axis relative to the outer housings 272L and 272R. Each inner housing 274L and 274R includes cavities 238 and 240 for respectively receiving a seat tube 222 and a back-rest tube 224. The cavities 238 and 240 are adapted to snugly and securely receive the seat and back-rest tubes 222 and 224, respectively. The seat tubes 222 and the back-rest tubes 224 can be removably snap fit into the cavities 238 and 240 to ensure a solid connection so that the set-up rocker 210 remains stable and sturdy when a user is seated, and especially when the user is rocking in the rocker 210.

As illustrated in FIG. 20, each of the inner housing 272L and 272R includes an internal cavity 276, and each of the outer housings 274L and 274R includes an internal cavity 278. When pairs of outer and inner housings 272 and 274 are adjacently positioned, the respective internal cavities 276 and 278 align to receive a torsion spring 270 or other compliant member. During rocking motion of the rocker 210—that is, when the inner housings 272L and 272R move relative to the outer housings 274L and 274R, the torsion springs 270 facilitate the rocking motion between relative forward and rearward positions, imparting a forwards and backwards rocking motion to the movable portion of the central hub 216.

Alternative compliant members may also be used to impart the rocking motion between the movable and stationary portions of the central hub. For example, leaf springs or flexible tension rods can be used in a similar manner to the transversely extending spring rods shown and described herein.

The images and description of embodiments herein generally illustrate a stowaway compact rocker with front-to-back rocking motion. Notably, the present invention also has utility providing side-to-side rocking motion, such as for a pack seat concept or a baby cradle or bassinet, without departing from the principles and spirit of the present invention. Such alternate designs would utilize the general concepts described herein, namely a central hub design having a stationary portion and a movable portion, wherein said central hub would extending front-to-back instead of transversely, and more preferably utilize a central axle tube and inner and outer spring rods or compliant members extending front-to-back, or in the alternative, torsion springs relatively positioned on the front and back of a central axle tube, so that the seat or cradle portion will rock side-to-side.

In an alternate embodiment of the stowaway compact rocker in accordance with the present invention, a storage/carrying bag can be provided to hold the collapsed and bundled rocker, such as illustrated in FIG. 6, for storage and/or transportation. This bag can be provided with an opening along it length for inserting the collapsed and bundled rocker. When the rocker is set-up, the bag can be placed over the top of the back-rest. In embodiments, the bag includes a pillow projecting on the outer surface of the bag, and when the bag is placed over the top of the back-rest, the bag/pillow provides a pillow for the seated user. In alternate designs, the pillow can be a padded projection or a foam sewn into the sidewall of the bag. Still further, the pillow can be a foam insert removably provided in a pocket formed on the bag, or a pocket with an inflatable bladder, so that the bag can be smaller when in storage/carrying bag mode as opposed to pillow mode.

Still further, use of the bag over the top of the back-rest can provide stability to the set-up rocker. As noted, a headrest brace 26 can be used, but is not necessary. Instead, the carrying bag can act as the headrest brace, and in this regard, can include a reinforcing member (such as a sewn-in brace member) to improve stability of the set-up chair.

Additionally, the storage/carrying bag can include additional storage pockets for holding personal effects when using the set-up chair with the bag placed over the top of the back-rest.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular uses contemplated.

What is claimed is:

1. A stowaway compact rocker having a set-up condition and a collapsed and bundled condition, and further having rocking capability when in the set-up condition; said rocker comprising:

a stationary chair frame base comprising:

a central axle tube;

a pair of leg plates disposed at opposing longitudinal ends of the central axle tube; and a pair of front leg tubes and a pair of rear legs tubes, each of said front leg tubes and rear leg tubes being adapted for connection to a respective one of the leg plates;

a movable seating chair frame adapted for rocking movement relative to the stationary chair frame base comprising a pair of seat tube plates mounted on the central axle tube for rotation thereabout;

a pair of seat member tubes, each of said seat member tubes being adapted for connection to a respective one of the seat tube plates; and a pair of back-rest member tubes, each of said back-rest member tubes being adapted for connection to a respective one of the seat tube plates;

at least one inner spring rod transversely connected between the seat tube plates, said at least one inner spring rod being adapted for rotational movement about the central axle tube with said seat tube plates;

at least one outer spring rod transversely connected between the leg plates;

at least one center spring rod plate mounted on the central axle tube for rotation thereabout, wherein the at least one inner spring rod and the at least one outer spring rod pass through said at least one center spring rod plate such that rotational movement of the at least one inner spring rod effects movement of the at least one center spring rod plate, which in turn flexes the at least one outer spring rod; and a seating fabric mounted to the seat member tubes and the back-rest member tubes in the set-up condition of the rocker and defining a chair seat and a chair back-rest adapted to receive a seated user in the set-up rocker;

wherein the movable seating chair frame is adapted for movement relative to the stationary chair frame base when a pressure is applied to at least one of the chair seat and the chair back-rest by a seated user.

2. The stowaway compact rocker according to claim 1, wherein the transverse positioning of the at least one center spring rod plate along the central axle tube is adjustable.

3. The stowaway compact rocker according to claim 2, wherein the transverse positioning of the at least one center spring rod plate is adjustable by sliding movement along the central axle tube.

4. The stowaway compact rocker according to claim 2, wherein the transverse positioning of the at least one center spring rod plate is adjustable by a rack-and-pinion means.

5. The stowaway compact rocker according to claim 1, wherein the front and rear leg tubes are connected to the leg plates in the set-up condition of the rocker and said front and rear leg tubes are removed from the leg plates in the collapsed and bundled condition of the rocker; and wherein the seat member tubes and back-rest member tubes are connected to the seat tube plates in the set-up condition of the rocker and said seat member tubes and back-rest member tubes are removed from the seat tube plates in the collapsed and bundled condition of the rocker.

6. The stowaway compact rocker according to claim 5, wherein the front leg tubes, rear leg tubes, seat member tubes and back-rest member tubes are shock-corded to remain connected to the rocker even when in the collapsed and bundled condition of the rocker.

7. The stowaway compact rocker according to claim 1, wherein the back-rest member tubes each define a distal end positioned away from the seat tube plates which are connected to one another by a headrest brace.

8. The stowaway compact rocker according to claim 1, wherein each of the seat tube plates being positioned transversely inward from a respective leg plate.

9. A stowaway compact rocker having a set-up condition and a collapsed and bundled condition, and further having rocking capability when in the set-up condition; said rocker comprising:

a stationary chair frame base comprising:

a central axle tube;

a pair of leg plates disposed at opposing longitudinal ends of the central axle tube; and a pair of front leg tubes and a pair of rear legs tubes, each of said front leg tubes and rear leg tubes being adapted for connection to a respective one of the leg plates;

a movable seating chair frame adapted for rocking movement relative to the stationary chair frame base comprising:

a pair of seat tube plates mounted on the central axle tube for rotation thereabout;

a pair of seat member tubes, each of said seat member tubes being adapted for connection to a respective one of the seat tube plates; and a pair of back-rest member tubes, each of said back-rest member tubes being adapted for connection to a respective one of the seat tube plates;

a rocker mechanism operatively connected between the stationary chair frame base and the movable seating chair frame, wherein the rocker mechanism comprises:

at least one inner spring rod transversely connected between the seat tube plates, said at least one inner spring rod being adapted for rotational movement about the central axle tube with said seat tube plates;

at least one outer spring rod transversely connected between the leg plates; and a seating fabric mounted to the seat member tubes and the back-rest member tubes in the set-up condition of the rocker and defining a chair seat and a chair back-rest adapted to receive a seated user in the set-up rocker;

wherein the movable seating chair frame is adapted for movement relative to the stationary chair frame base when a pressure is applied to at least one of the chair seat and the chair back-rest by a seated user.

10. The stowaway compact rocker according to claim 9, further comprising at least one center spring rod plate mounted on the central axle tube for rotation thereabout, wherein the at least one inner spring rod and the at least one outer spring rod pass through said at least one center spring rod plate such that rotational movement of the at least one inner spring rod effects movement of the at least one center spring rod plate, which in turn flexes the at least one outer spring rod.

11. The stowaway compact rocker according to claim 9, further comprising two center spring rod plates mounted on the central axle tube at transversely space apart positions for rotation thereabout, wherein the at least one inner spring rod and the at least one outer spring rod pass through said center spring rod plates such that rotational movement of the at least one inner spring rod effects movement of the center spring rod plates, which in turn flexes the at least one outer spring rod.

12. The stowaway compact rocker according to claim 11, wherein the transverse positioning of the center spring rod plates relative to one another along the central axle tube is adjustable.

13. The stowaway compact rocker according to claim 12, wherein the transverse positioning of the center spring rod plates relative to one another is adjustable by sliding movement along the central axle tube.

14. The stowaway compact rocker according to claim 12, wherein the transverse positioning of the center spring rod plates relative to one another is adjustable by a rack-and-pinion means.

15. The stowaway compact rocker according to claim 9, wherein the front and rear leg tubes are connected to the leg plates in the set-up condition of the rocker and said front and rear leg tubes are removed from the leg plates in the collapsed and bundled condition of the rocker; and wherein the seat member tubes and back-rest member tubes are connected to the seat tube plates in the set-up condition of the rocker and said seat member tubes and back-rest member tubes are removed from the seat tube plates in the collapsed and bundled condition of the rocker.

16. The stowaway compact rocker according to claim 15, wherein the front leg tubes, rear leg tubes, seat member tubes and back-rest member tubes are shock-corded to remain connected to the rocker even when in the collapsed and bundled condition of the rocker.

17. The stowaway compact rocker according to claim 9, wherein the back-rest member tubes each define a distal end positioned away from the seat tube plates which are connected to one another by a head rest brace.

18. The stowaway compact rocker according to claim 9, wherein each of the seat tube plates being positioned transversely inward from a respective leg plate.

* * * * *